US006729299B2

(12) United States Patent
Anschicks et al.

(10) Patent No.: US 6,729,299 B2
(45) Date of Patent: May 4, 2004

(54) THROTTLE BODY

(75) Inventors: Rolf Anschicks, Butzbach (DE); Eugen Bernarding, Usingen (DE)

(73) Assignee: Siemens Aktiengesellschaft, Munich (DE)

( * ) Notice: Subject to any disclaimer, the term of this patent is extended or adjusted under 35 U.S.C. 154(b) by 158 days.

(21) Appl. No.: 10/200,049

(22) Filed: Jul. 18, 2002

(65) Prior Publication Data

US 2003/0024505 A1 Feb. 6, 2003

(30) Foreign Application Priority Data

Aug. 2, 2001 (DE) ..... 101 37 454

(51) Int. Cl.[7] ..... F02D 1/00
(52) U.S. Cl. ..... 123/399; 251/129.11; 123/361
(58) Field of Search ..... 123/361, 337, 123/399, 376; 251/129.11

(56) References Cited

U.S. PATENT DOCUMENTS

| | | | | | |
|---|---|---|---|---|---|
| 5,016,589 | A | * | 5/1991 | Terazawa | 123/399 |
| 5,022,369 | A | * | 6/1991 | Terazawa | 123/399 |
| 5,076,385 | A | * | 12/1991 | Terazawa et al. | 180/197 |
| 5,619,195 | A | * | 4/1997 | Allen et al. | 341/20 |
| 5,698,778 | A | * | 12/1997 | Ban et al. | 73/118.1 |
| 5,711,271 | A | | 1/1998 | Schlagmueller | |
| 6,116,216 | A | | 9/2000 | Wright | |
| 6,400,141 | B1 | * | 6/2002 | Apel et al. | 324/207.2 |
| 6,443,135 | B1 | * | 9/2002 | Dismon et al. | 123/568.18 |
| 6,502,544 | B2 | * | 1/2003 | Kamiya et al. | 123/396 |
| 6,543,417 | B2 | * | 4/2003 | Tanaka et al. | 123/399 |

FOREIGN PATENT DOCUMENTS

| | | |
|---|---|---|
| DE | 3826408 | 2/1991 |
| DE | 4333800 | 4/1995 |
| DE | 19635280 | 3/1997 |
| DE | 19719991 | 11/1998 |
| DE | 19728349 | 1/1999 |
| DE | 19825727 | 12/1999 |
| DE | 19843770 | 3/2000 |
| DE | 19903490 | 8/2000 |
| DE | 29909201 | 10/2000 |
| DE | 10051912 | 5/2001 |
| DE | 10023695 | 6/2001 |
| EP | 0596392 | 5/1994 |
| JP | 2000130187 | 5/2000 |

OTHER PUBLICATIONS

JP 2000130187 A., In: Patent Abstract of Japan, Sep. 5, 2000.

* cited by examiner

*Primary Examiner*—John Kwon
(74) *Attorney, Agent, or Firm*—Martin A. Farber

(57) ABSTRACT

A throttle body (10) with a housing (12) comprising a housing cover (17) and a housing body (14) and with a through throttle aperture (20) for a throttle butterfly (26) arranged on a throttle-butterfly shaft (22), the throttle-butterfly shaft (22) being drivable as a function of specifiable parameters by an electronic system (56) arranged in the housing (12) by an electric actuator (32) likewise arranged in the housing (12) and having an actuator shaft (28), the position of the throttle-butterfly shaft (22) being detectable by a position detection device (70) arranged in the housing (12), is to have a particularly small space requirement and, at the same time, a contactless position detection device (70) for the throttle-butterfly shaft (22) For this purpose, the electronic system (56) for the electric actuator (32) is arranged in the housing cover (17), and the position detection device (70) comprises a Hall-effect magnet (76) arranged on the actuator shaft (28) and a Hall-effect sensor (72) arranged directly next to the Hall-effect magnet (76) for detecting the position of the throttle-butterfly shaft (22).

9 Claims, 3 Drawing Sheets

THROTTLE BODY

FILED OF THE INVENTION

The invention relates to a throttle body with a housing comprising a housing cover and a housing body and with a through throttle aperture for a throttle butterfly arranged on a throttle-butterfly shaft, the throttle-butterfly shaft being drivable as a function of specifiable parameters by means of an electronic system arranged in the housing by an electric actuator likewise arranged in the housing and having a drive shaft, the position of the throttle-butterfly shaft being detectable by means of a position detection device arranged in the housing.

To control the quantity of fresh gas to be fed to the combustion engine of a motor vehicle, use is generally made of throttle bodies. Throttle bodies comprise a housing with a through throttle aperture and a throttling member arranged in the throttle aperture. The throttling member is generally a throttle butterfly, which is arranged pivotably on a throttle-butterfly shaft mounted in the housing. The throttle butterfly arranged on the throttle-butterfly shaft assumes a certain position in the throttle aperture to allow through a certain quantity of fresh gas. For this purpose, the throttle-butterfly shaft, on which the throttle butterfly is arranged, can be activated mechanically or electronically.

In part of the range, e.g. the idling range, the throttle butterfly of a throttle body can be movable by an actuator and, in the remainder of the range, can be movable with the aid of a wire cable coupled to the accelerator pedal of the motor vehicle. As an alternative, however, the throttle butterfly can also be movable by an actuator over its entire range of adjustment. In these last-mentioned systems, there is no mechanical connection between the desired-value input, in particular the accelerator pedal, and the throttle butterfly. Triggered by the depression of the accelerator pedal, the power demand in these "electronic engine output control" or "drive-by-wire" systems is converted into an electrical signal. The electrical signal is fed to a control unit, which, in turn, produces an activation signal for the actuator from the electrical signal.

To avoid faults during the transmission of the activation signal from the control unit to the actuator of the throttle-butterfly shaft in electronic engine output control systems, there are throttle bodies in which the control unit for the actuator is integrated into the housing of the throttle body. In this case, the control unit can be integrated into an electronic system arranged in the housing. In this arrangement, the electronic system is provided for further functions of the throttle body, e.g. for activating position monitoring of the throttle-butterfly shaft and detecting and storing data relating to the throttle body.

For the purpose of monitoring the position of the throttle-butterfly shaft, a position detection device is generally provided. There are position detection devices that detect the current position of the throttle-butterfly shaft by contact with the throttle-butterfly shaft. Alternatively, there are position detection devices that detect the respectively current position of the throttle-butterfly shaft in a contactless manner. Contactless position detection devices generally have a particularly large space requirement since they have to be arranged in alignment with the throttle-butterfly shaft, as a result of which the axial length of the throttle body housing is generally increased considerably.

SUMMARY OF THE INVENTION

The object underlying the invention is to specify a throttle body of the abovementioned type, the housing of which has a particularly small space requirement and which furthermore has a contactless position detection device for the throttle-butterfly shaft.

According to the invention, this object is achieved by virtue of the fact that the electronic system for the electric actuator is arranged in the housing cover, and the position detection device comprises a Hall-effect magnet arranged on the drive shaft and a Hall-effect sensor arranged directly next to the Hall-effect magnet for the purpose of detecting the position of the throttle-butterfly shaft.

The invention starts from the consideration that the housing of the throttle body has a particularly small space requirement if the elements of the throttle body are arranged in a particularly compact way. A contactless position detection device for a throttle-butterfly shaft of a throttle body can also be arranged with a particularly small space requirement in the housing of the throttle body if it detects the current position of the throttle-butterfly shaft indirectly, rather than directly. A particularly large amount of space is saved if the position detection device is connected functionally to other elements of the throttle body. For this purpose, the position detection device comprises a Hall-effect magnet arranged on the drive shaft of the actuator and a Hall-effect sensor arranged directly next to the Hall-effect magnet.

The electric actuator is advantageously an electrically commutated motor. An electrically commutated motor is less prone to wear than an electric motor with carbon brushes and furthermore is particularly quiet. Owing to the absence of friction associated with carbon brushes, the electrically commutated motor takes less current, has a comparatively low power loss and develops less heat during operation than an electric motor with carbon brushes. Moreover, an electrically commutated motor has shorter actuating times and a better response than an electric motor with carbon brushes. Finally, an electrically commutated motor is simpler to assemble since the complex assembly of the brush holder plate is eliminated.

The electronic system for the electric actuator is advantageously arranged on a board in the housing cover. A board is particularly simple to fit in the housing cover of the housing of the throttle body and furthermore has a particularly small overall height.

The evaluation module for the output signals of the Hall-effect sensor is advantageously arranged on the board in the housing cover.

In addition to the first electronic system of the electric actuator, a second electronic system for electric appliances arranged outside the housing is advantageously arranged in the housing cover of the housing of the throttle body, the second electronic system being arranged on the board together with the first electronic system. As a result, the electronic system of the throttle body does not need to be coupled separately to a so-called electronic engine control system. As a result, the path of the signal of the Hall-effect sensor to the electronic evaluation system is particularly short. Moreover, the current position of the throttle butterfly can then be coordinated in a particularly simple manner, by means of the signal of the Hall-effect sensor, with further parameters of the engine in which the throttle body is arranged.

The housing cover is advantageously composed predominantly of plastic, electrical connection means, by means of which the first electronic system for the electric actuator and the second electronic system for the appliances arranged outside the housing can be brought into contact at least with the electric appliances arranged outside the housing, being integrated into the housing cover. Connection means of this kind can be integrated into the housing cover in a particularly simple manner if the latter has been produced by injection molding. Moreover, the contacts for the electronic system can then be integrated into the housing cover of the housing of the throttle body at fixed predeterminable points.

The electric appliances are advantageously arranged in a combustion engine of a motor vehicle. Thanks to the spatial connection between the electronic system for the actuator and the electronic system for the electric appliances arranged outside the housing, the combustion engine has a central electronic system, as a result of which the number of elements of the combustion engine is particularly small. Moreover, faults due to signal transmissions from the first to the second electronic system are virtually eliminated.

The electric appliances arranged outside the housing are advantageously an ignition appliance and/or an injection appliance and/or an oil-level measuring appliance and/or an air-mass regulating appliance and/or a power supply appliance.

The throttle-butterfly shaft can advantageously be driven by the electric actuator via a reduction gear connected to the actuator shaft, the position detection device being arranged at one end of the actuator shaft and the reduction gear being arranged at the other end of the actuator shaft. The spatial separation of the gear and the position detection device is a particularly reliable means of ensuring that no abraded material from the gear gets into the position detection device.

The arrangement of a contactless position detection device on the actuator shaft of an electric actuator for the throttle-butterfly shaft of the throttle body enables the position detection device to be arranged in the housing of the throttle body with a particularly small space requirement. Here, the respectively current position of the throttle-butterfly shaft is detected indirectly via the drive shaft of the actuator.

An exemplary embodiment of the invention is explained in greater detail with reference to the drawing, in which:

BRIEF DESCRIPTION OF THE DRAWINGS

Parts that correspond to one another are provided with the same reference numerals in all the figures.

DETAILED DESCRIPTION OF THE PREFERRED EMBODIMENT

Figure 1:
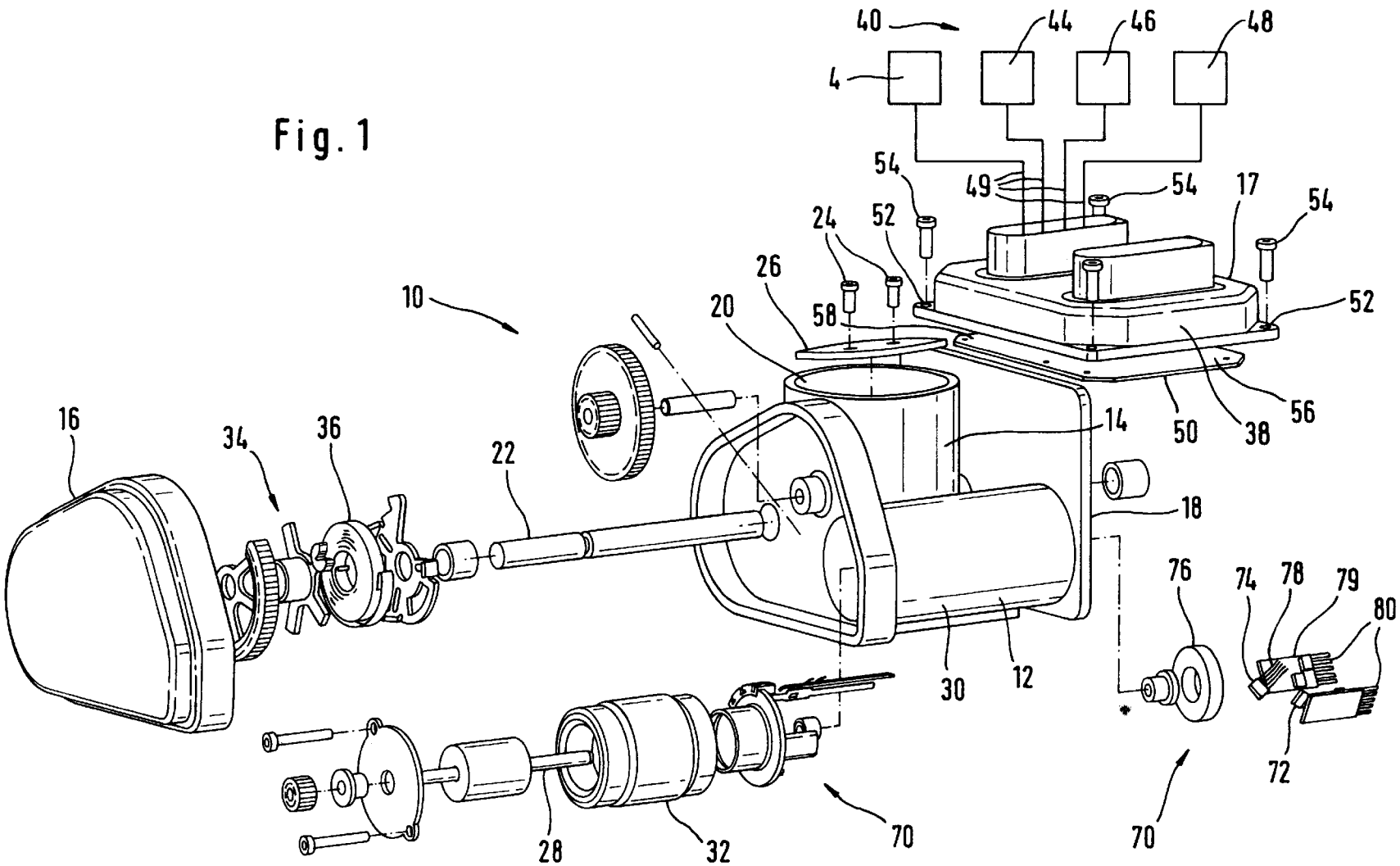
FIG. 1 shows schematically a throttle body.

The throttle body 10 shown in FIG. 1 is used to feed air or a fuel/air mixture to a consumer (not shown), e.g. an injection device of a motor vehicle (likewise not shown), it being possible to control the quantity of fresh gas to be fed to the consumer by means of the throttle body 10. For this purpose, the throttle body 10 has a housing 12, which comprises a housing body 14, a first housing cover 16 and a second housing cover 17. The housing 12 is manufactured predominantly from aluminum 18. As an alternative, however, the housing 12 can also be manufactured from plastic. Arranged in the housing body 14 is a through throttle aperture 20, via which air or a fuel/air mixture can be fed to the consumer (not shown). To allow the volume of fresh gas fed in to be adjusted, a throttle butterfly 26 is arranged on a throttle-butterfly shaft 22 with the aid of fastening means 24. The throttle-butterfly shaft 22, the fastening means 24 and the throttle butterfly 26 can be seen in exploded representation in FIG. 1.

Rotating the throttle-butterfly shaft 22 simultaneously pivots the throttle butterfly 26 arranged on the throttle-butterfly shaft 22. Pivoting the throttle butterfly 26 increases or reduces the opening of the throttle aperture 20. The quantity of fluid passing through the throttle aperture 20 can thereby be adjusted. The throughput of air or fuel/air mixture through the throttle aperture 20 of the throttle body 10 is thus regulated by means of a movement of the throttle butterfly 26.

The throttle-butterfly shaft 22 can be connected to a cable pulley (not shown specifically), which, in turn, is connected by a Bowden pull to an adjusting apparatus for a power demand. In this context, the adjusting apparatus can be constructed as an accelerator pedal of a motor vehicle, actuation of this adjusting apparatus by the driver of the motor vehicle thus enabling the throttle butterfly 26 to be moved from a position of minimum opening, in particular a closed position, as far as a position of maximum opening, in particular an open position, in order thereby to control the power output of the motor vehicle.

In contrast, it is possible either for the throttle-butterfly shaft 22, illustrated in FIG. 1, of the throttle body 10 to be adjusted by an actuator over part of the range and otherwise by means of the accelerator pedal or for the throttle butterfly 26 to be adjusted over the entire range of adjustment by an actuator. In these "electronic engine output control" or "drive-by-wire" systems, mechanical power control, e.g. depressing an accelerator pedal, is converted into an electric signal. This signal, in turn, is fed to a control unit, which produces an activation signal for the actuator. In these systems, there is no mechanical coupling between the accelerator pedal and the throttle butterfly 26 in normal operation.

To fix the throttle-butterfly shaft 22 and hence the throttle butterfly 26, the throttle body 10 therefore has an actuator housing 30. The actuator housing 30 is formed integrally with the housing 12 of the throttle body 10. Alternatively, the housing 12 of the throttle body 10 and the actuator housing 30 can also be of two-piece design. An electric actuator 32 designed as a commutated electric motor is arranged in the actuator housing 30. The electric actuator 32 designed as a commutated electric motor is connected to the throttle-butterfly shaft 22 by means of a reduction gear 34. The throttle-butterfly shaft 22 can thus be pivoted by the actuator 32 designed as a commutated electric motor.

To ensure a defined position of the throttle-butterfly shaft 22 and hence of the throttle butterfly 26, even if the electric actuator 32 fails, a return spring 36 is assigned to the reduction gear 34. The return spring 36 pivots the throttle-butterfly shaft into a position corresponding to an idling position of the throttle butterfly 26 if the actuator 32 fails.

The gear-side area of the housing 12 of the throttle body 10 can be closed by the first housing cover 16, which is manufactured from plastic but, as an alternative, can also be manufactured from metal. That area of the housing 12 of the throttle body 10 that faces away from the gear can be closed by the second housing cover 17. The second housing cover 17 is likewise manufactured from plastic 38. As an alternative, however, the second housing cover 17 can also be manufactured from metal, in particular aluminum. The second housing cover 17 is produced from plastic 38 by injection molding. During this process, electrical connection means have been placed in the injection mold provided for the second housing cover 17 and have been embedded at least partially in the plastic 38 during the injection-molding process. By means of the electrical connection means (not shown specifically in the drawing), the throttle body 10 can be connected to electric appliances 40 arranged outside the throttle body 10. In this exemplary embodiment, the electric appliances, which are indicated schematically in FIG. 1, are an ignition appliance 42, an injection appliance 44, an oil-level measuring appliance 46 and an air-mass regulating appliance 48. The electric appliances 40 are connected electrically to the electrical connection means of the housing cover 17 of the throttle body by electrical leads 49. Like the throttle body 10, the electric appliances 40 are arranged in the combustion engine of the motor vehicle, although neither the combustion engine nor the motor vehicle are shown specifically in the drawing.

The electrical connection means of the second housing cover 17 are connected to the electric actuator 32 via a board 50. The board 50 has holes 52, via which the board 50 can be arranged on the second housing cover 17 of the throttle body 10 by means of fastening means 54 designed as metallic screws.

Arranged on the board 50 are a first electronic system for the electric actuator 32 and a second electronic system 58 for the electric appliances 40 arranged outside the housing 12. Both the first electronic system 56 and the second electronic system 58 can be connected to the electric appliances 40 arranged outside the throttle body 10 by the electrical connection means, which are arranged at least partially in the second housing cover 17. The first electronic system 56 and the second electronic system 58 are mounted in an integrated manner on the board 50. It is therefore not possible to distinguish from the outside which area of the board 50 belongs to the first electronic system 56 and which area of the board belongs to the second electronic system 58. As an alternative, however, the board 50 can also have areas that are clearly distinguishable from the outside that are provided for the first electronic system 56 and the second electronic system 58. The second electronic system 58 for the appliances 40 arranged outside the housing 12 of the throttle body 10 comprises a control unit, a data acquisition unit and a data storage unit.

For the purpose of detecting the respectively current position of the throttle-butterfly shaft 22, the throttle body 10 has a contactless position detection device 70. The contactless position detection device 70 comprises a first Hall-effect sensor 72 and a second Hall-effect sensor 74 and a Hall-effect magnet 76. The Hall-effect magnet 76 has areas of N magnetization and S magnetization that alternate in the form of pie segments. The Hall-effect magnet 76 is arranged on the opposite end of the actuator shaft 28 from the reduction gear 34. The Hall-effect magnet 76 thus turns when the actuator shaft 28 of the electric actuator 32 turns. With its rotary motion, the actuator shaft 28 adjusts the throttle-butterfly shaft 22 via the reduction gear 34 and hence adjusts the throttle butterfly 26 arranged on the throttle-butterfly shaft 22. With the reduction ratio of the reduction gear 34, it is therefore possible precisely to determine the respectively current position of the throttle-butterfly shaft 22 and hence of the throttle butterfly 26 via the actuator shaft 28 of the actuator 32 by means of the Hall-effect magnet 76.

The rotary motion of the Hall-effect magnet 76 can be detected by means of the first Hall-effect sensor 72 and the second Hall-effect sensor 74. For this purpose, the first Hall-effect sensor 72 and the second Hall-effect sensor 74 are arranged radially along the circumference of the Hall-effect magnet 76, relative to the latter. Two Hall-effect sensors 72 and 74 are used in order to achieve better resolution in the detection of the rotary motion of the Hall-effect magnet 76 than would be the case with just one Hall-effect sensor 72 or 74. Voltages are produced in the first Hall-effect sensor 72 and the second Hall-effect sensor 74 during a rotary motion of the Hall-effect magnet 76. These voltages are a measure of the rotary motion of the Hall-effect magnet 76. These voltages can be fed to a printed circuit board 79 via electrical contacts 78 provided on the first Hall-effect sensor 72 and the second Hall-effect sensor 74. The printed circuit board 79, in turn, can be connected via electrical contacts 80 to the board 50 on which the first electronic system 56 and the second electronic system 58 are arranged.

Figure 2:
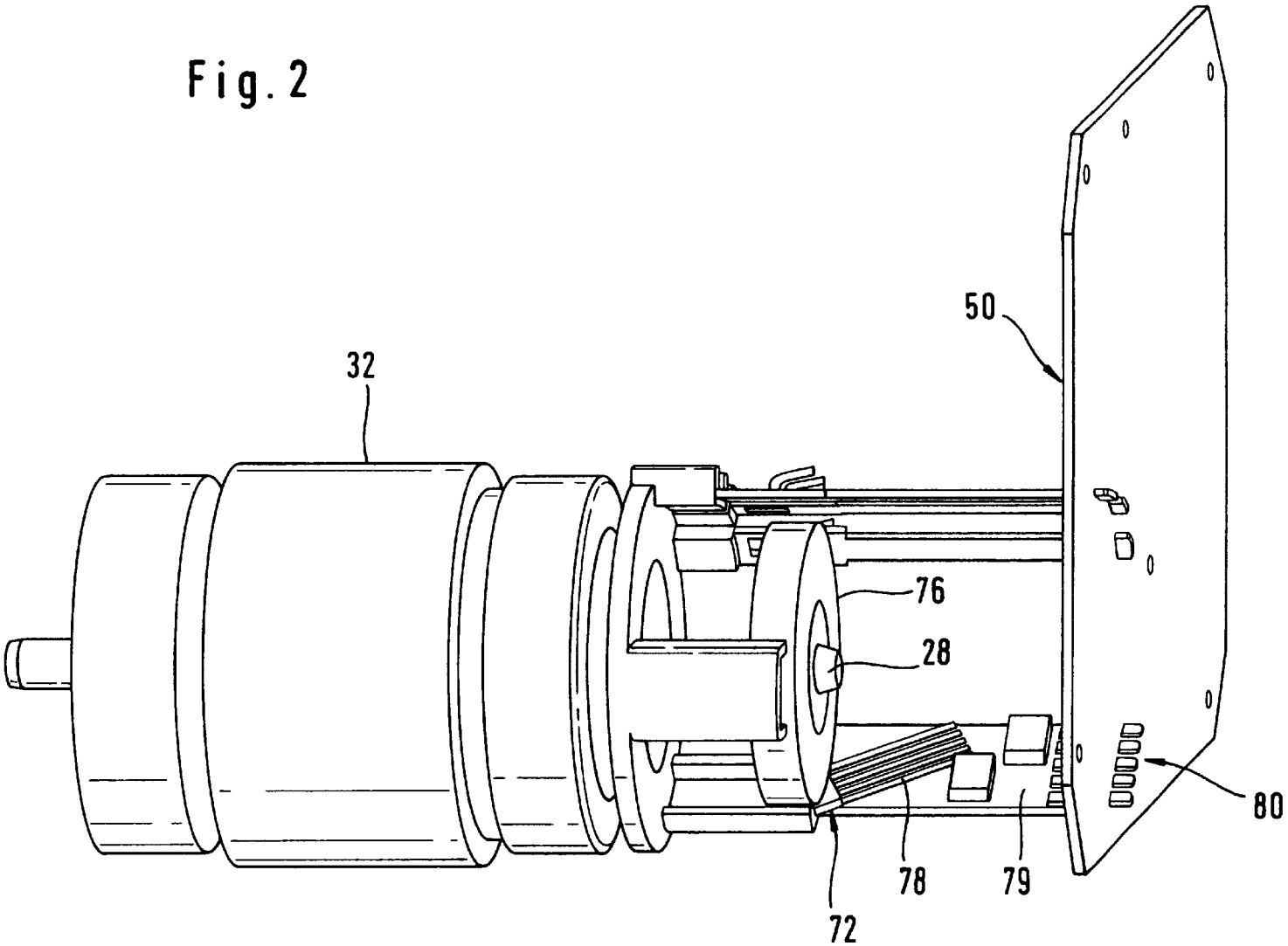
FIG. 2 shows schematically the electric actuator with the position detection device.

FIG. 2 shows how the electrical contacts 80 make contact with the board 50. The electrical connection means 80. Before the installation of the board 50 in the second housing cover 17 of the throttle body 10, the actuator 32 is connected to the position detection device 70 and connected electrically to the board 50. As a result, the amount of work required to assemble the throttle body 10 is particularly small.

Figure 3:
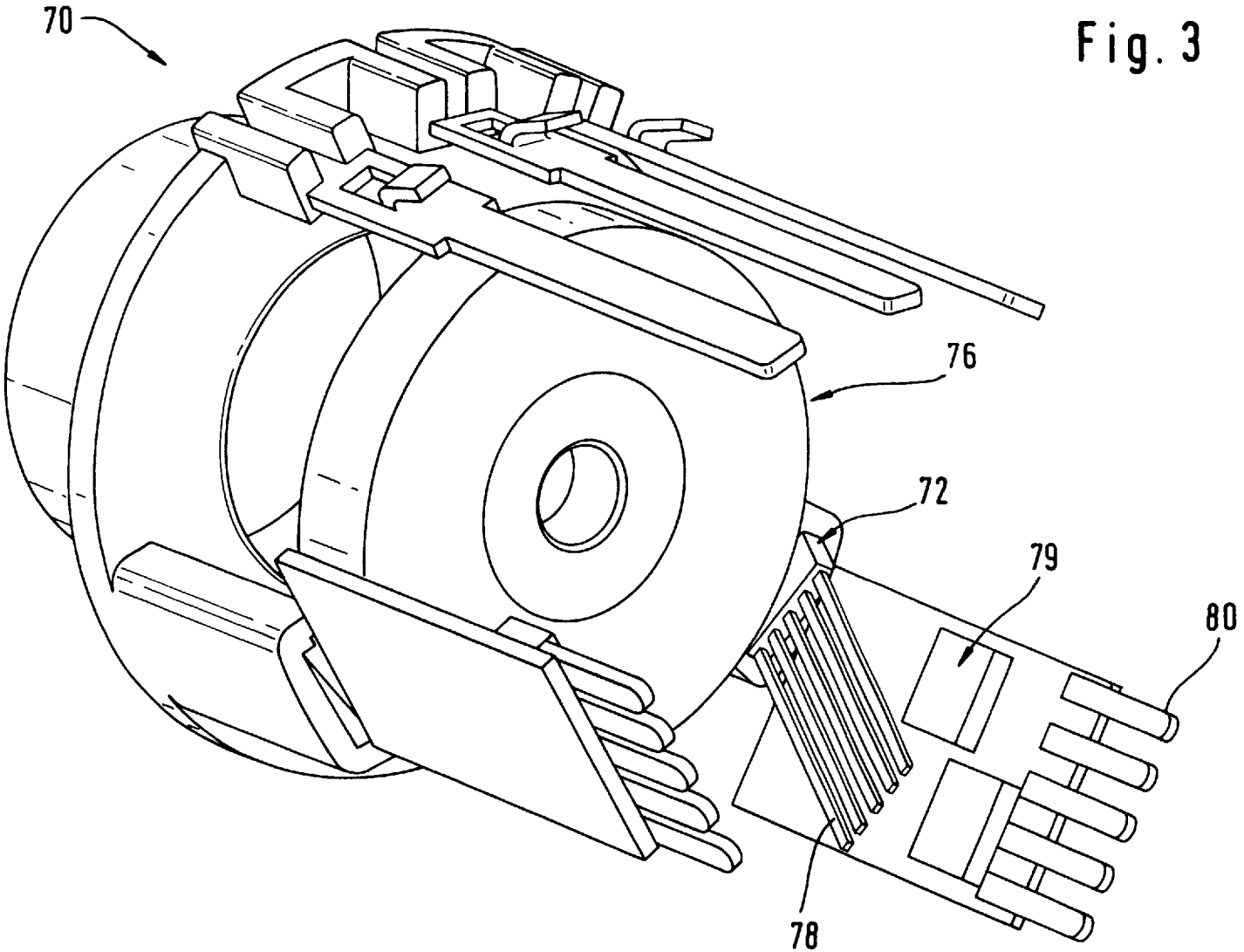
FIG. 3 shows schematically the position detection device.

The position detection device 70 is illustrated in detail in FIG. 3. The way in which the Hall-effect sensor 72 is arranged radially on the outer circumference of the Hall-effect magnet 76 is clearly visible.

During operation of the throttle body 10, the electric actuator 32 is activated by the first electronic system 56 to adjust the throttle-butterfly shaft 22. The throttle-butterfly shaft 22 is then adjusted as a function of the control parameters by means of a rotary motion of the actuator shaft 28 and by means of the reduction gear 34. During this process, the rotary motion of the throttle-butterfly shaft 22 is detected indirectly in a contactless manner by means of the position detection device 70.

During a rotary motion of the actuator shaft 28 of the electric actuator 32, the Hall-effect magnet 76 arranged on the actuator shaft 28 turns. The rotary motion of the Hall-effect magnet 76 produces a voltage in the first Hall-effect sensor 72 and the second Hall-effect sensor 74. These two voltages are fed to the printed circuit board 79 via the electrical contacts 78. The printed circuit board 79, which comprises capacitors, transmits signals to the first electronic system 56. In the first electronic system, values corresponding to a particular position of the throttle-butterfly shaft 22 are assigned to the signals of the first Hall-effect sensor 72 and the second Hall-effect sensor 74. To determine these values, the current signal of the respective Hall-effect sensor 72 or 74 is, for example, associated with a calibration curve stored in the first electronic system, from which the value corresponding to the current position of the throttle-butterfly shaft 22 is then determined.

The housing of the throttle body 10 requires a particularly small amount of space since the contactless position detection device 70 of the throttle-butterfly shaft 22 does not detect this position of the throttle-butterfly shaft 22 directly but indirectly via the actuator shaft 28 of the actuator 32.

What is claimed is:

1. A throttle body (10) with a housing (12) comprising a housing cover (17) and a housing body (14) and with a through throttle aperture (20) for a throttle butterfly (26) arranged on a throttle-butterfly shaft (22), the throttle-butterfly shaft (22) being drivable as a function of specifiable parameters by an electronic system (56) arranged in the housing (12) by an electric actuator (32) likewise arranged in the housing (12) and having an actuator shaft (28), position of the throttle-butterfly shaft (22) being detectable by a position detection device arranged in the housing (12), wherein the electronic system (56, 58) for the electric actuator (32) is arranged in the housing cover (17), and the position detection device (70) comprises a Hall-effect magnet (76) arranged on the actuator shaft (28) and a Hall-effect sensor (72, 74) arranged directly next to the Hall-effect magnet (76) for detecting the position of the throttle-butterfly shaft (22).

2. The throttle body (10) as claimed in claim 1, wherein the electric actuator (32) is an electrically commutated motor.

3. The throttle body (10) as claimed in claim 1, wherein the electronic system for the electric actuator (32) is arranged on a board (82) in the housing cover (16, 17).

4. The throttle body (10) as claimed in claim 3, wherein in addition to first said electronic system (56) of the electric actuator (32), a second electronic system (58) for electric appliances (40) arranged outside the housing (12) is arranged in the housing cover (16, 17), the second electronic system (58) being arranged on the board (82) together with the first electronic system (56).

5. The throttle body as claimed in claim 4, wherein the housing cover (16, 17) is composed predominantly of plastic (38), and wherein there is provided electrical connection means (80), by which the first electronic system (56) for the electric actuator (32) and the second electronic system (58) for the electric appliances (40) arranged outside the housing (12) are bringable into contact at least with the electric appliances (40) arranged outside the housing (12), being integrated into the housing cover (16, 17).

6. The throttle body (10) as claimed in claim 4, wherein the electric appliances (40) are arranged in a combustion engine of a motor vehicle.

7. The throttle body (10) as claimed in claim 5, wherein the electric appliances (40) arranged outside the housing (12) are an ignition appliance and/or an injection appliance and/or an oil-level measuring appliance (46) and/or an air-mass regulating appliance (48) and/or an ignition appliance (42).

8. The throttle body (10) as claimed in claim 1, wherein the throttle-butterfly shaft (22) is drivable by the electric actuator (32) via a reduction gear (34) connected to the actuator shaft (28), the position detection device (70) being arranged at one end of the actuator shaft (28) and the reduction gear (34) being arranged at another end of the actuator shaft (28).

9. The throttle body (10) as claimed in claim 5, wherein the electric appliances (40) are arranged in a combustion engine of a motor vehicle.

* * * * *